US008733024B2

(12) United States Patent
Vogel et al.

(10) Patent No.: US 8,733,024 B2
(45) Date of Patent: May 27, 2014

(54) FLEXIBLE DOOR WITH RIGID INSULATION

(75) Inventors: Lynn D. Vogel, Chambersburg, PA (US); Curtis L. Berry, Williamsport, MD (US)

(73) Assignee: Jamison Door Company, Hagerstown, MD (US)

( * ) Notice: Subject to any disclaimer, the term of this patent is extended or adjusted under 35 U.S.C. 154(b) by 586 days.

(21) Appl. No.: 12/847,010

(22) Filed: Jul. 30, 2010

(65) Prior Publication Data

US 2011/0011003 A1 Jan. 20, 2011

Related U.S. Application Data

(63) Continuation-in-part of application No. 11/262,418, filed on Oct. 28, 2005, now abandoned.

(60) Provisional application No. 61/230,185, filed on Jul. 31, 2009.

(51) Int. Cl.
*E06B 3/00* (2006.01)

(52) U.S. Cl.
USPC ..... 49/501; 49/141; 49/404; 49/409

(58) Field of Classification Search
USPC ..... 49/501, 409, 410, 411, 404, 366, 360, 49/370, 116, 141, 120; 160/196.1, 199, 160/200, 232; 52/243.1, 309.9, 794.1, 52/404.1, 784.14, 784.15; 428/319.3, 428/319.7, 492, 518, 522
See application file for complete search history.

(56) References Cited

U.S. PATENT DOCUMENTS 643,307 A 2/1900 Schmitt
843,011 A 2/1907 Hale et al.
887,912 A * 5/1908 Bokor ..... 52/404.1
1,220,910 A 3/1917 Toll
1,245,882 A 11/1917 Davis
1,406,951 A 2/1922 Fehr (Continued)

FOREIGN PATENT DOCUMENTS

DE 573632 8/1932
DE 2043 581 4/1971

(Continued)

OTHER PUBLICATIONS

Jamison Sound Reduction, Special Purpose, Cold Storage Doors brochure, Jamison Door Company (1998) pp. 1-12.

*Primary Examiner* — Katherine Mitchell
*Assistant Examiner* — Shiref Mekhaeil
(74) *Attorney, Agent, or Firm* — Frost Brown Todd LLC

(57) ABSTRACT

A door system comprises a door panel, a support member, and a pivoting vertical plate. The door panel comprises a plurality of discrete rigid insulation pieces interposed between flexible layers. An outer skin encompasses the rigid insulation pieces and the flexible layers. The door panel is secured to the support member by the outer skin, such that the outer skin bears the weight of the door panel. The vertical plate is secured to a trailing side of the door panel. The vertical plate includes keepers that selectively engage hooks extending from a casing positioned at a doorway. The rigidity of the door panel depends on the pivotal position of the vertical plate relative to a plane defined by the door panel. The door panel provides sufficient flexibility to withstand impacts from objects and vehicles yet also provides sufficient rigidity to insulate a cold environment from a warm environment.

16 Claims, 9 Drawing Sheets

(56) References Cited

U.S. PATENT DOCUMENTS

| | | | | | |
|---|---|---|---|---|---|
| 1,439,373 | A | | 12/1922 | Norwood et al. | |
| 1,534,210 | A | | 4/1925 | Griffith et al. | |
| 1,681,545 | A | | 8/1928 | Lang | |
| 1,960,860 | A | | 4/1934 | Allen | |
| 2,373,023 | A | | 4/1945 | Goodwin | |
| 2,425,016 | A | | 8/1947 | Weaver | |
| 2,517,713 | A | | 8/1950 | Rissler | |
| 2,619,167 | A | | 11/1952 | Eckel | |
| 2,760,567 | A | * | 8/1956 | Eckel et al. | 160/368.1 |
| 2,878,532 | A | | 4/1959 | Clark | |
| 2,949,150 | A | * | 8/1960 | Traynor, Jr. | 428/324 |
| 3,065,826 | A | | 11/1962 | Tucker, Jr. | |
| 3,074,124 | A | | 1/1963 | Bergstedt | |
| 3,215,058 | A | | 11/1965 | Anderson | |
| 3,254,503 | A | | 6/1966 | Rundell | |
| 3,305,973 | A | * | 2/1967 | Bohn | 49/438 |
| 3,332,167 | A | * | 7/1967 | Fayer | 49/33 |
| 3,334,464 | A | * | 8/1967 | Charles | 52/784.15 |
| 3,421,568 | A | | 1/1969 | Youngs | |
| 3,425,162 | A | | 2/1969 | Halpern | |
| 3,449,925 | A | | 6/1969 | Barroero | |
| 3,468,771 | A | | 9/1969 | Pedlow | |
| 3,529,382 | A | | 9/1970 | Salvarola | |
| 3,675,377 | A | | 7/1972 | Suter | |
| 3,734,238 | A | | 5/1973 | Secresty et al. | |
| 3,805,450 | A | | 4/1974 | Foreina | |
| 3,807,480 | A | | 4/1974 | Smart | |
| 3,816,234 | A | * | 6/1974 | Winfield | 428/317.9 |
| 3,817,161 | A | | 6/1974 | Koplon | |
| 3,854,263 | A | | 12/1974 | Eckel | |
| 3,859,502 | A | | 1/1975 | Heaney | |
| 3,869,873 | A | | 3/1975 | Thomas | |
| 3,903,567 | A | * | 9/1975 | Suska | 16/301 |
| 3,912,049 | A | | 10/1975 | Holland et al. | |
| 3,979,872 | A | | 9/1976 | Gilchrist et al. | |
| 3,987,588 | A | | 10/1976 | Imperial et al. | |
| 4,058,191 | A | | 11/1977 | Balbo | |
| 4,083,148 | A | | 4/1978 | Saucier | |
| 4,084,347 | A | | 4/1978 | Brown | |
| 4,115,953 | A | | 9/1978 | Brosenius | |
| 4,127,765 | A | | 11/1978 | Heaney | |
| 4,177,540 | A | * | 12/1979 | Gorton | 16/335 |
| 4,218,104 | A | | 8/1980 | Anderson et al. | |
| 4,223,482 | A | | 9/1980 | Barroero et al. | |
| 4,276,919 | A | * | 7/1981 | Walters | 160/206 |
| 4,382,461 | A | | 5/1983 | Schenker | |
| RE31,328 | E | | 8/1983 | Anderson et al. | |
| 4,404,770 | A | | 9/1983 | Markus | |
| 4,445,958 | A | | 5/1984 | Jaksha | |
| 4,516,482 | A | | 5/1985 | Smith | |
| 4,588,235 | A | | 5/1986 | Barroero | |
| 4,592,270 | A | | 6/1986 | Vener | |
| 4,619,975 | A | | 10/1986 | Matzner et al. | |
| 4,637,176 | A | | 1/1987 | Acock, Jr. | |
| 4,651,469 | A | | 3/1987 | Ngian | |
| 4,698,278 | A | | 10/1987 | Prang | |
| 4,735,293 | A | | 4/1988 | Everhart et al. | |
| 4,758,299 | A | | 7/1988 | Burke | |
| 4,831,780 | A | | 5/1989 | Bockwinkel | |
| 4,855,567 | A | | 8/1989 | Mueller | |
| 4,941,289 | A | | 7/1990 | Rolek | |
| 4,950,869 | A | | 8/1990 | Mueller | |
| 4,961,454 | A | | 10/1990 | Reilly, Jr. et al. | |
| 4,987,638 | A | | 1/1991 | Ribaudo | |
| 5,007,226 | A | | 4/1991 | Nelson | |
| 5,035,085 | A | | 7/1991 | Mamelson et al. | |
| 5,080,950 | A | | 1/1992 | Burke | |
| 5,083,639 | A | | 1/1992 | Kappeler | |
| 5,111,618 | A | | 5/1992 | Kaspar et al. | |
| 5,119,593 | A | | 6/1992 | Bae | |
| 5,129,184 | A | | 7/1992 | Fish | |
| 5,143,137 | A | | 9/1992 | West | |
| 5,165,142 | A | | 11/1992 | Pilsbury | |
| 5,195,594 | A | | 3/1993 | Allen et al. | |
| 5,203,175 | A | | 4/1993 | Farrey et al. | |
| 5,255,473 | A | | 10/1993 | Kaspar et al. | |
| 5,271,236 | A | | 12/1993 | Sweetser | |
| 5,305,855 | A | | 4/1994 | Rivera et al. | |
| 5,309,680 | A | | 5/1994 | Kiel | |
| 5,322,174 | A | | 6/1994 | Wolters | |
| 5,329,781 | A | | 7/1994 | Farrey et al. | |
| 5,361,552 | A | | 11/1994 | Fulford | |
| 5,383,510 | A | | 1/1995 | Allen | |
| 5,418,342 | A | | 5/1995 | Miller | |
| 5,427,205 | A | | 6/1995 | Saillio et al. | |
| 5,584,191 | A | | 12/1996 | Kwon | |
| 5,729,989 | A | | 3/1998 | Sunaga et al. | |
| 5,743,057 | A | | 4/1998 | Martin | |
| 5,899,303 | A | | 5/1999 | Allen | |
| 5,915,445 | A | | 6/1999 | Rauenbusch | |
| 5,924,298 | A | | 7/1999 | Yoo | |
| 5,927,015 | A | | 7/1999 | Ghosn et al. | |
| 5,927,095 | A | | 7/1999 | Lee | |
| 5,975,664 | A | | 11/1999 | Banicevic et al. | |
| 6,056,383 | A | | 5/2000 | Banicevic et al. | |
| 6,144,017 | A | | 11/2000 | Millett et al. | |
| 6,152,208 | A | | 11/2000 | Kalempa et al. | |
| 6,164,739 | A | * | 12/2000 | Schulz et al. | 312/406 |
| 6,225,904 | B1 | | 5/2001 | Jaffe et al. | |
| 6,226,995 | B1 | | 5/2001 | Kalempa et al. | |
| 6,301,913 | B1 | | 10/2001 | Schulak et al. | |
| 6,330,763 | B1 | | 12/2001 | Kern et al. | |
| 6,360,487 | B1 | | 3/2002 | Kern et al. | |
| 6,408,636 | B1 | | 6/2002 | Backes et al. | |
| 6,468,615 | B2 | * | 10/2002 | Weinstein et al. | 428/43 |
| 6,519,899 | B1 | * | 2/2003 | Hurzeler | 49/501 |
| 6,712,117 | B2 | * | 3/2004 | Jella | 160/229.1 |
| 6,824,851 | B1 | * | 11/2004 | Locher et al. | 428/76 |
| 6,983,565 | B2 | | 1/2006 | Berry et al. | |
| 7,000,359 | B2 | * | 2/2006 | Meyer | 52/309.9 |
| 7,222,457 | B2 | * | 5/2007 | Delgado et al. | 49/141 |
| 7,565,770 | B2 | * | 7/2009 | Delgado et al. | 49/141 |
| 8,215,369 | B1 | * | 7/2012 | Kelley | 160/236 |
| 2002/0170265 | A1 | | 11/2002 | Tokonabe et al. | |
| 2003/0173040 | A1 | * | 9/2003 | Court et al. | 160/230 |
| 2004/0000112 | A1 | * | 1/2004 | Alderman | 52/407.3 |
| 2004/0031204 | A1 | * | 2/2004 | Thompson | 49/501 |
| 2004/0206004 | A1 | * | 10/2004 | Kalempa et al. | 49/370 |
| 2004/0261318 | A1 | * | 12/2004 | Berry et al. | 49/209 |
| 2005/0204698 | A1 | * | 9/2005 | Werner et al. | 52/783.1 |
| 2005/0241781 | A1 | * | 11/2005 | Johnson | 160/199 |
| 2006/0090401 | A1 | | 5/2006 | Berry et al. | |
| 2006/0231218 | A1 | * | 10/2006 | Liang | 160/206 |
| 2007/0068083 | A1 | * | 3/2007 | Huang | 49/381 |
| 2007/0163196 | A1 | * | 7/2007 | Barrow | 52/406.3 |
| 2008/0122324 | A1 | * | 5/2008 | Bienick | 312/116 |
| 2009/0077898 | A1 | * | 3/2009 | Gerichten | 49/506 |
| 2009/0155612 | A1 | * | 6/2009 | Pervan et al. | 428/498 |
| 2009/0235599 | A1 | * | 9/2009 | Ware et al. | 52/309.9 |
| 2009/0313931 | A1 | * | 12/2009 | Porter | 52/309.4 |
| 2010/0132894 | A1 | * | 6/2010 | Knutson et al. | 160/113 |
| 2010/0203781 | A1 | * | 8/2010 | Gellatly | 441/129 |
| 2012/0018102 | A1 | * | 1/2012 | Ungs et al. | 160/113 |

FOREIGN PATENT DOCUMENTS

| | | |
|---|---|---|
| DE | 298 08 179 | 7/1998 |
| EP | 0 478 938 | 4/1992 |
| FR | 980892 | 5/1951 |
| FR | 2 315 598 | 1/1977 |
| FR | 2 582 343 | 11/1986 |
| GB | 2 219 618 | 12/1989 |

* cited by examiner

FLEXIBLE DOOR WITH RIGID INSULATION

PRIORITY

This application claims priority to U.S. Provisional Patent Application Ser. No. 61/230,185, filed Jul. 31, 2009, entitled "Flexible Door with Rigid Insulation," the disclosure of which is incorporated by reference herein.

This application is also a continuation-in-part of U.S. Non-Provisional patent application Ser. No. 11/262,418, filed Oct. 28, 2005, entitled "Air Heated, Flexible Door Panel," published as U.S. Pub. No. 2006/0090401, the disclosure of which is incorporated by reference herein.

BACKGROUND

In some settings, it may be desirable to provide a door that provides adequate insulation between a relatively cool room (e.g., walk-in/drive-in freezer, etc.) and a relatively warmer room. For instance, such a door may be placed between a refrigerated room and an adjacent room that is at room temperature or at some other warmer temperature. It may also be desirable in some settings to provide a door that is flexible enough to withstand at least some types of impacts (e.g., collision with a forklift or other vehicle, a hand cart with loaded pallet, etc.) without significant damage resulting to the door; and with the door still being able to provide a substantial thermal seal between rooms separated by the door. Various suitable locations for positioning such a door as described herein will be apparent to those of ordinary skill in the art in view of the teachings herein. Of course, adequate insulation may be provided by a door in some settings without the door also having to provide flexibility or impact absorption. Likewise, adequate flexibility or impact absorption may be provided by a door in some settings without the door also having to provide substantial insulation. Some conventional door systems may provide a high degree of rigidity (e.g., to increase thermal isolation/insulation capabilities) at the expense of impact absorption capabilities. Some other conventional door systems may provide a high degree of flexibility (e.g., to increase impact absorption capabilities) at the expense of thermal isolation/insulation capabilities. While a variety of doors have been made and used, it is believed that no one prior to the inventor has made or used an invention as described herein.

BRIEF DESCRIPTION OF THE DRAWINGS

It is believed the present invention will be better understood from the following description of certain examples taken in conjunction with the accompanying drawings, in which like reference numerals identify the same elements and in which.

Figure 1:
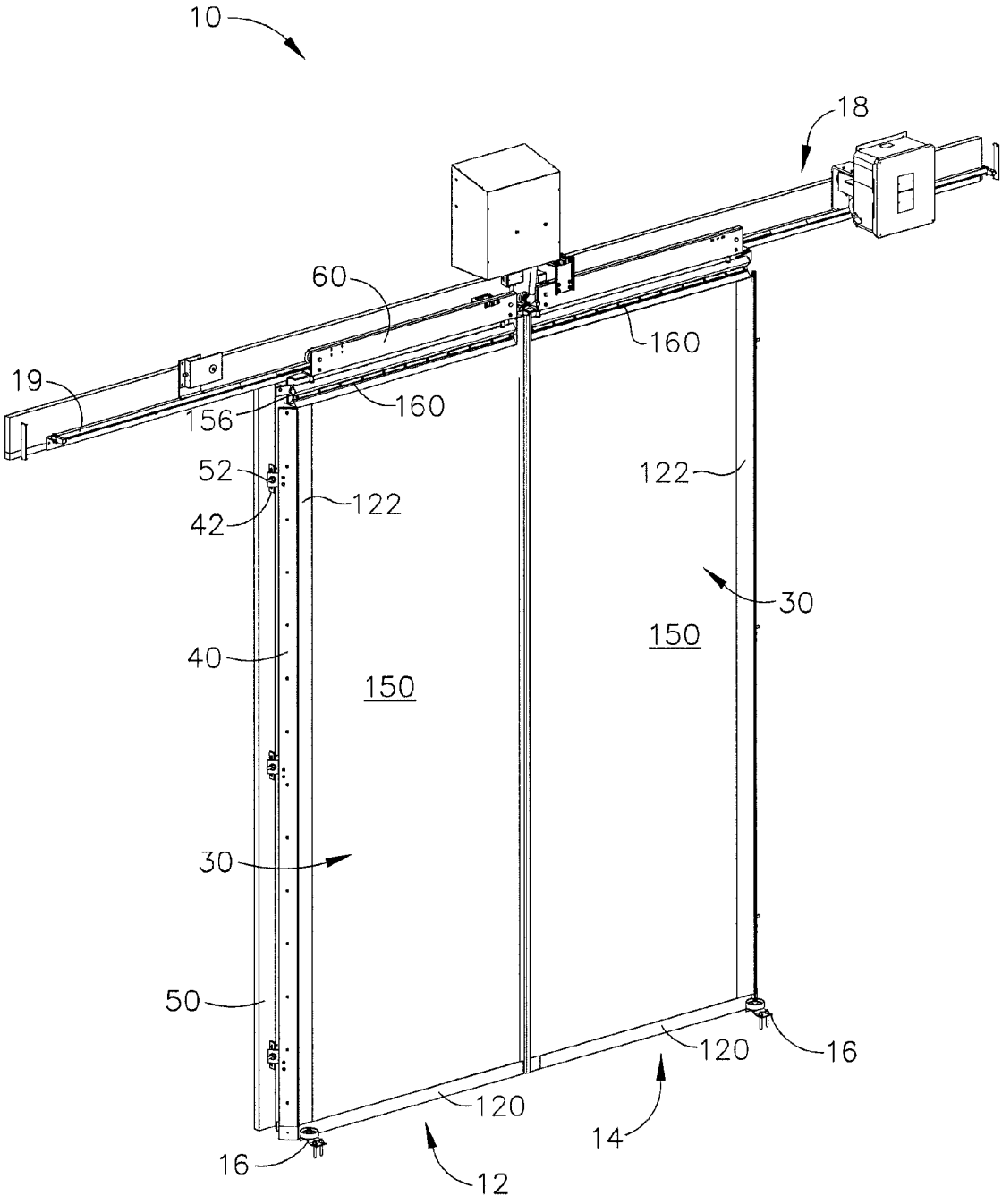
FIG. 1 depicts a perspective view of an exemplary two-panel door system, with the door panels in a closed configuration.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

Overview

As shown in FIGS. 1-4, the door system (10) of the present example comprises a pair of door panels (12, 14) that are mounted to a track system (18). In particular, track system (18) of the present example includes a horizontal track (19). Door panels (12, 14) are engaged with track (19) via carriers (60). Track system (18) is operable to slide door panels (12, 14) horizontally along track (19) between a closed configuration (example shown in FIG. 1) and an open configuration (example shown in FIG. 2) by translating carriers (60) that have rollers (not shown) engaged to track (19). Thus, in some versions, track system (18) and carriers (60) cooperate to move door panels (12, 14) through a range of motion along a path that is substantially parallel to the ground. When in a closed configuration, door panels (12, 14) are configured to cooperate with each other and with frame components (50, 52) as will be described in greater detail below, to provide a substantially sealed barrier between adjacent rooms or environments that are separated by door system (10). Frame components (50, 52) are mounted to a wall or other fixed structure in the present example, though any or all of frame components (50, 52) may be otherwise mounted as desired. In addition, a pair of roller guides (16) are mounted to the floor adjacent to door panels (12, 14) in the present example; and are configured to guide door panels (12, 14) as they move between the open configuration and the closed configuration. In particular, roller guides (16) help keep door panels (12, 14) substantially coplanar with each other and close to the wall to allow engagement of the frame mounted portion of the sealing system (52) as door system (10) opens and closes in the present example. Of course, as with other components described herein, roller guides (16) are merely optional, and may be modified, substituted, supplemented, or omitted as desired.

As described in greater detail below, some versions of door system (10) provide door panels (12, 14) that are significantly lightweight, that have significant thermal isolation/insulation capabilities, and that can significantly withstand impacts or collisions from objects or vehicles, etc., without significant damage resulting to door panels (12, 14). Of course, some versions of door system (10) may provide only some of these capabilities or aspects/properties in addition to providing other capabilities or aspects/properties.

While the examples described herein are provided in the context of two door panels (12, 14), it should be understood that the teachings herein may also be applied to door systems having only one door panel (12, 14) or more than two door panels (12, 14). Accordingly, the teachings herein should not be viewed as being limited to a two-panel door system (10). Ways in which the teachings herein may be applied to door systems having just one door panel (12, 14) or more than two door panels (12, 14) will be apparent to those of ordinary skill in the art in view of the teachings herein. Similarly, it should be understood that the teachings herein may also be applied to door systems where door panels (12, 14) are not coplanarly aligned with each other. By way of example only, some variations of door system (10) may include door panels (12, 14) that are planarly parallel yet planarly offset from each other. Ways in which the teachings herein may be applied to door systems having door panels (12, 14) that are not coplanarly aligned with each other will be apparent to those of ordinary skill in the art in view of the teachings herein.

In some versions where only a single door panel (12, 14) is used, an additional bulkhead (not shown) may be installed at the door opening. Such a bulkhead may include a vertically extending recess that presents an engagement surface (e.g., a flat surface, a surface configured to complement the surface of the leading edge of door panel (12, 14), etc.) that is configured and positioned to engage with leading edge of door panel (12, 14) when the door is closed. Such a recess and/or engagement surface may be sized to provide some freedom of movement when the door is closed, allowing door panel (12, 14) to flex away from the associated wall, while still providing a suitable seal. In some settings (e.g., a freezer door), such a bulkhead may be heated in any suitable fashion, such as to prevent condensation or icing. In the absence of such a bulkhead or other component providing a recess and/or engagement surface the flexibility of door panel (12, 14) may cause door panel (12, 14) to buckle or bend in response to differences between air pressures on opposing faces of door panel (12, 14). Such bending or buckling may cause door panel (12, 14) to bend into the door opening and strike the jamb of the door before the door is fully closed, which may be undesirable in some settings.

Exemplary Sealing of Door Panels

Figure 2:
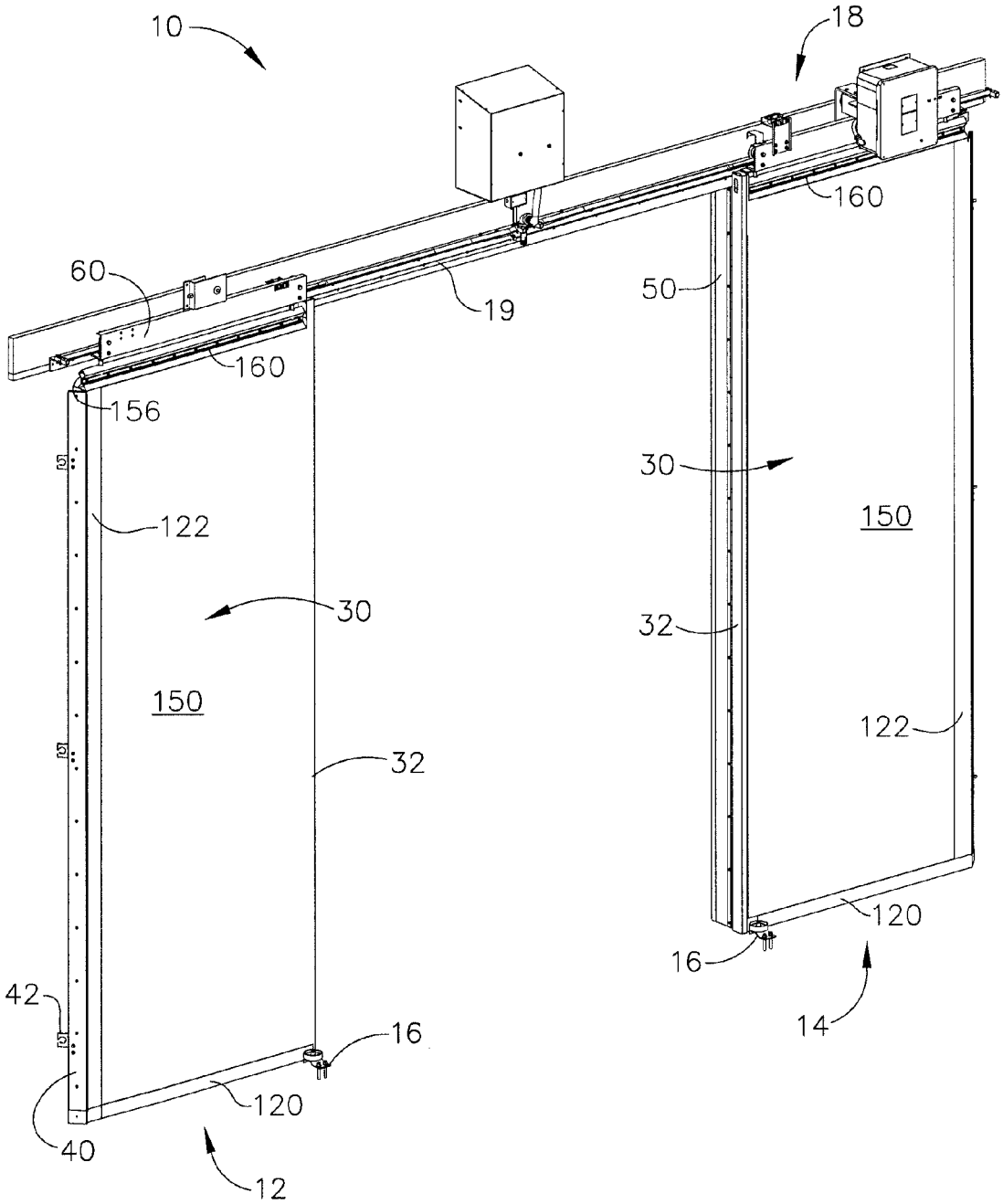
FIG. 2 depicts a perspective view of the two-panel door system of FIG. 1, with the door panels in an open configuration.
Figure 3:
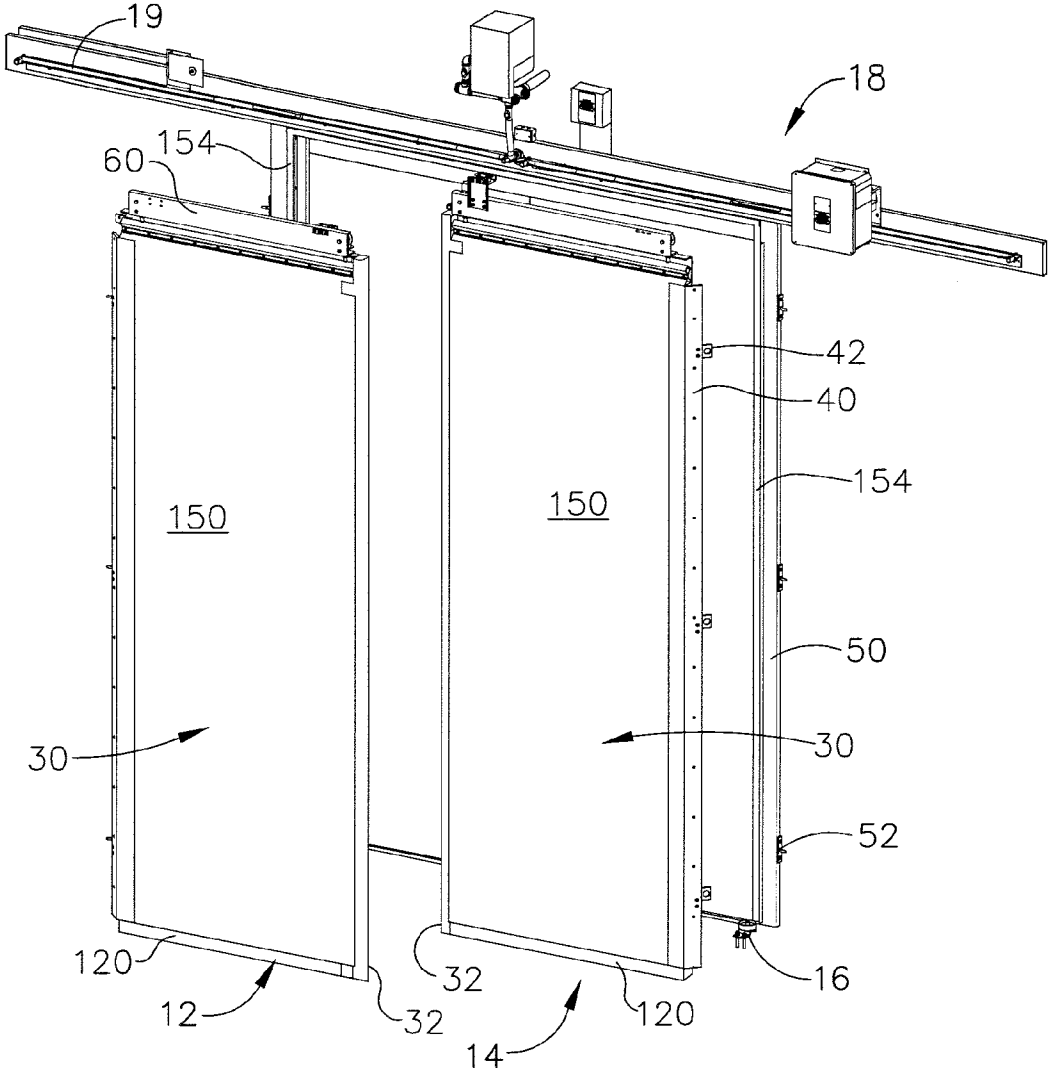
FIG. 3 depicts a perspective view of the two-panel door system of FIG. 1, with the door panels separated from the door frame.
Figure 9:
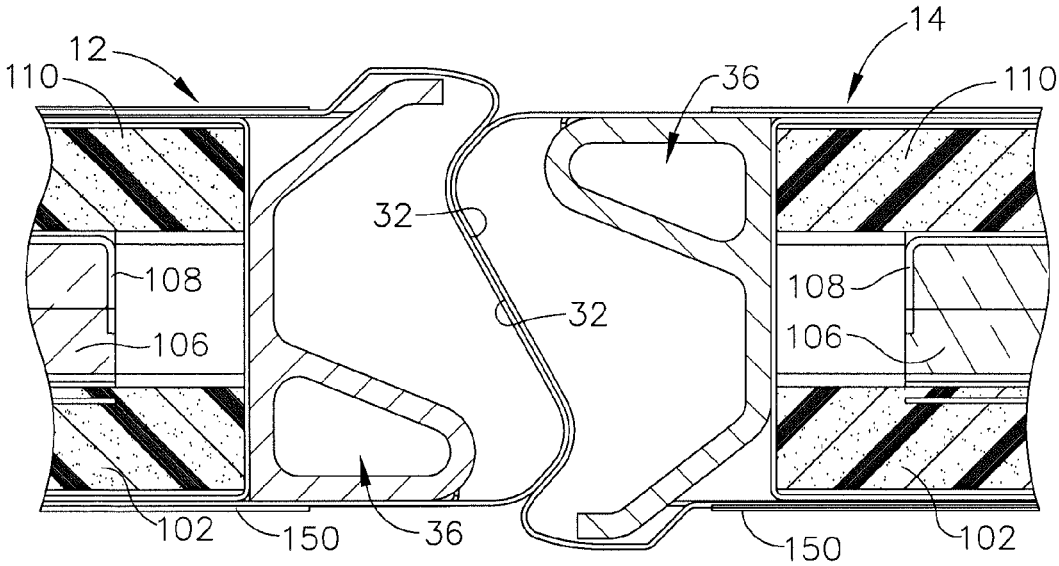
FIG. 9 depicts a partial top plan view of the two-panel door system of FIG. 1, showing engagement of the leading edges of the door panels while the door panels are in a closed configuration.

As shown in FIG. 2, door panels (12, 14) each have a front face (30), a leading edge (32), and a trailing edge plate (40). As shown in FIG. 9, leading edges (32) have complementary "C"-like configurations. In particular, leading edges (32) are configured to self-align and seal against each other when door panels (12, 14) are brought together, such as when door system (10) is closed. Mating leading edges (32) of door panels (12, 14) may thus provide a substantial seal when leading edges (32) are nested together. As also shown in FIG. 9, door panels (12, 14) may also include one or more heat passages (36). Such heat passages (36) may use hot air heating, electrical resistance heating, or any other type of heating. Such heating may reduce or prevent the occurrence of freezing or condensation at leading edges (32); and/or may provide other results in some settings. Of course, as with other components described herein, heat passages (36) in door panels (12, 14) are merely optional.

In some versions where door system (10) has only one door panel (12, 14), it should be understood that an engagement member (not shown) may be fixed to casing (50) of the door frame (e.g., as part of the bulkhead assembly described above, etc.); and that such an engagement member may have a configuration complementing the configuration of leading edge (32) of solitary door panel (12, 14). In particular, such an engagement member may extend the entire vertical height of door panel (12, 14), and may mate with leading edge (32) of solitary door panel (12, 14) when a single-panel version of door system (10) is closed. Such an engagement member may also optionally include one or more heat passages (36) as described above. Such an engagement member may thus essentially mimic the presence of another door panel (12, 14) having a leading edge (32) that complements the leading edge (32) of the solitary door panel (12, 14) as described above. Alternatively, the leading edge (32) of a door panel (12, 14) in a door system (10) having just one door panel (12, 14) may simply abut or engage a flat surface or any other type of surface when such a solitary-panel door system (10) is closed.

Figure 8:
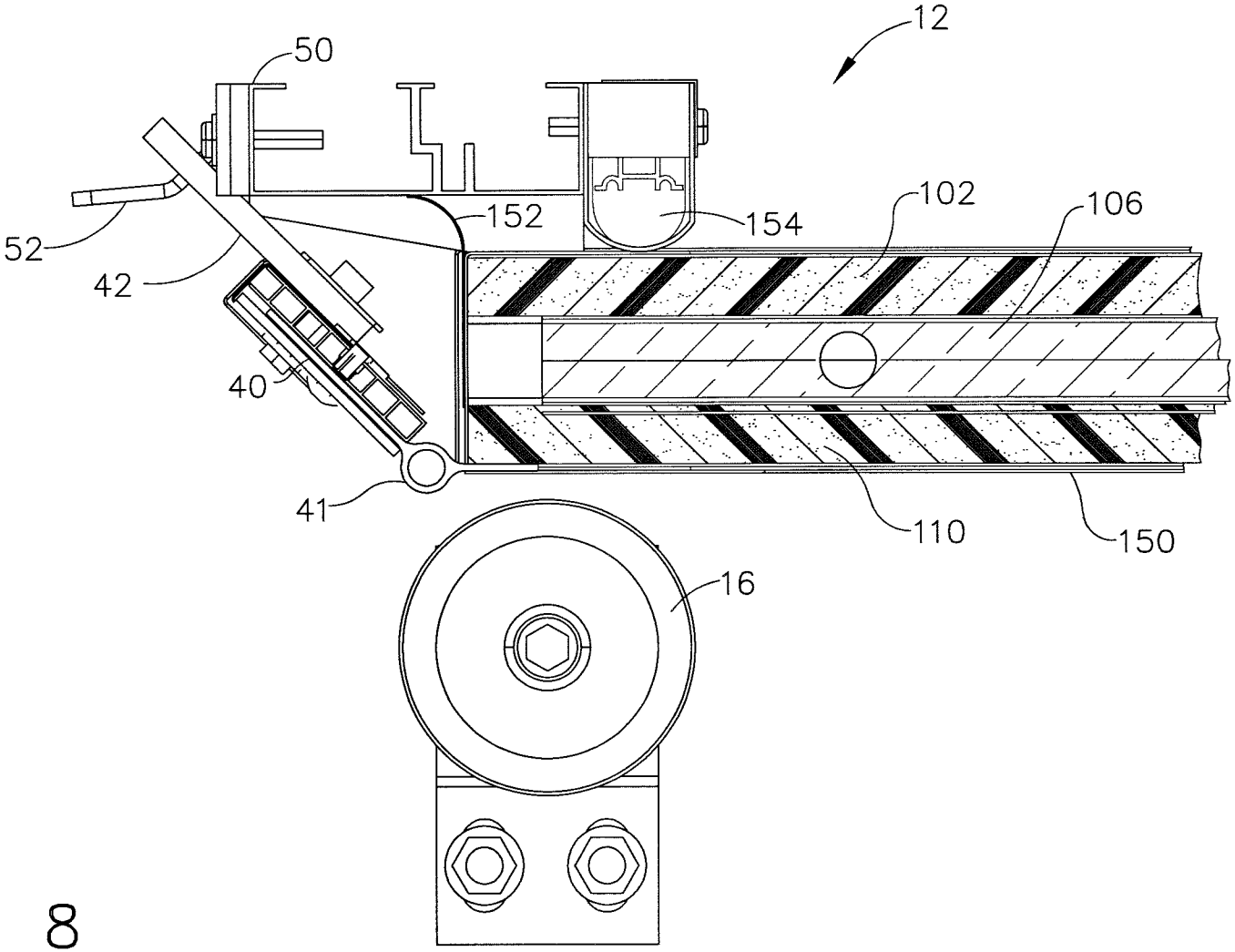
FIG. 8 depicts a partial top cross-sectional view of the two-panel door system of FIG. 1, showing engagement of door panel components with door frame components while the door panels are in a closed configuration.

As shown in FIG. 8, sealing may be provided at the trailing edge of door panels (12, 14) by components that are attached to a stationary wall and components that are attached to door panels (12, 14). In particular, a bulb gasket (154) is mounted to the inboard side of casing (50) of the door frame and a plurality of hooks (52) are mounted to the outboard side of casing (50); while a flap seal (152) and a plurality of keepers (42) are mounted to door panels (12, 14) in the present example. Hooks (52) are configured to engage keepers (42) when door system (10) is closed, as will be described in greater detail below. While bulb gasket (154) is shown as being mounted to vertically extending members of casing (50), it should be understood that bulb gaskets (154) may also be mounted to one or more horizontally extending members of casing (50), if desired. In the present example, bulb gasket (154) is heated (e.g., such as electrically, by hot air, or otherwise). Such heating may reduce or prevent condensation and icing of the gasket (154) and casing (50) area; and/or provide other results. Of course, bulb gasket (154) need not be heated in all versions, and may be non-heated if desired. Bulb gasket (154) of the present example is configured to seal against the back side of door panel (12, 14) to reduce or prevent the transport of air between the two environments that are separated by door system (10).

In some versions, and as will be described in greater detail below, the back side of door panel (12, 14) comprises a flexible material and may include bends and/or wrinkles in the surface that may be difficult to seal with bulb gasket (154). Accordingly, in some versions, flap seal (152) is provided as a second seal on the trailing edge of door panel (12, 14). Flap seal (152) may run the entire vertical height of door panel (12, 14), and may be configured to seal against the outboard edge or the door side of casing (50), particularly when door system (10) is closed. Having such a secondary seal may minimize or prevent infiltration at locations where a primary seal (e.g., provided by bulb gasket (154), etc.) is compromised due to wrinkling or bending of the flexible surface on the back face of door panel (12, 14). Such a secondary seal may also trap heat generated by a heated bulb gasket (154), with such heat being trapped between flap seal (152) and bulb gasket (154). Again, though, flap seal (152) is merely optional, and flap seal (152) may be modified, substituted, supplemented, or omitted as desired. Different versions of door system (10) may thus have just one or both of bulb seal (154) or flap seal (152) and/or any other type of seal, to the extent that door system (10) has any seal(s) at all. In addition, a floor seal (not shown) may optionally be provided at the lower edge of each door panel (12, 14), to substantially seal against the floor. Other suitable types of seals and/or locations for seals will be apparent to those of ordinary skill in the art in view of the teachings herein.

As noted above, hooks (52) of the door frame are configured to engage keepers (42) when door system (10) is closed. In particular, and as shown in FIGS. 1-2, 8, and 10, a plate (40) is pivotally mounted at the trailing edge of each door panel (12, 14) by a hinge (41). Keepers (42) are spaced along the length of plate (40) and are fixedly secured to plate (40). In the present example, plate (40) is formed of an acrylonitrile butadiene styrene (ABS) material, which may provide plate (40) with resilient properties. However, it should be understood that any other suitable material or combinations of materials may be used (e.g., various plastics, metals, combinations thereof, and/or other materials); and that plate (40) may have any other suitable properties.

In some versions, hinge (41) comprises a continuous hinge or piano hinge, though it should be understood that any other suitable pivoting connection may be used (e.g., a living hinge, several separate and discretely formed hinges, etc.). For instance, in some other versions, hinge (41) is formed simply by a piece of rubber or some other flexible material(s). In some such versions, such a piece of rubber is preformed in an "L"-shape, such that the piece of rubber is resiliently biased to position plate (40) at a non-parallel angle relative to door panel (12, 14); yet such that the piece of rubber may substantially flatten out to position plate (40) into a substantially parallel relationship with door panel (12, 14). It should therefore be understood that the term "hinge" should be read to include various components and configurations, and that the meaning of the term "hinge" is not intended to be limited to a mechanical device, a device with a pin, etc. Similarly, terms such as "hinge" and "pivot" should not be read as requiring one component to pivot relative to another component about a specific axis. Terms such as "hinge" and "pivot" should be read to include a component or feature whereby a component bends or otherwise moves relative to another component to vary an angle defined between those two components. Furthermore, it should be understood that hinge (41) and plate (40) may consist of a single unitary component (e.g., hinge (41) and plate (40) are formed of a homogenous continuum of material, etc.). Still other suitable components, features, and configurations that may be used for hinge (41) and/or plate (40) will be apparent to those of ordinary skill in the art in view of the teachings herein.

In the present example, three keepers (42) are spaced along the length of plate (40), though it should be understood that any other suitable number of keepers (42) may be used in any suitable arrangement. In addition, hooks (52) are positioned along casing (50) in a spacing that complements the positioning and spacing of keepers (42) on plate (40). Each keeper (42) further defines an opening or slot that is configured to receive a corresponding hook (52). In particular, hooks (52) engage with such openings or slots of keepers (42) when door system (10) is closed. The configuration of hooks (52) and the cooperation between hooks (52) and keepers (42) in the present example acts to urge door panels (12, 14) toward casing (50) as door system (10) is closed; thereby providing, encouraging, or facilitating a seal between bulb gaskets (154) and the rear face of door panels (12, 14).

Furthermore, and as will be described in greater detail below, the pivoting plates (40) of the present example may help increase the rigidity of the trailing edge of the door panels (12, 14) when plates (40) are pivoted to positions where plates (40) are non-parallel with door panels (12, 14) (see example in FIG. 8). Engagement between hooks (52) and keepers (42) as door system (10) is closed may provide and/or maintain such pivoting of plates (40) after door system (10) is closed, such that hooks (52) may hold plates (40) to a position where plates (40) are non-parallel with door panels (12, 14) when door system (10) is in the closed position. Having plates (40) pivoted to a non-parallel position relative to door panels (12, 14) may provide extra stiffening or rigidity of the edges to which plates (40) are attached to door panels (12, 14), which may in turn further facilitate or enhance a seal between the rear face of door panels (12, 14) and bulb gaskets (154) and may minimize quantity of keepers (42) needed to maintain the door seal.

While examples have been described above relating to sealing of door panels (12, 14) in door system (10), it should be understood that door system (10) may be substantially sealed in a variety of other ways (e.g., at leading edges (32), at the trailing edges of door panels (12, 14), and/or elsewhere within door system (10)). By way of example only, some versions of door system (10) may include bulb gasket (154) or some substitute therefor while not including flap seal (152). As another merely illustrative example, some versions of door system (10) may include flap seal (152) or some substitute therefor while not including bulb gasket (154). Still other ways in which door system (10) may be substantially sealed when closed will be apparent to those of ordinary skill in the art in view of the teachings herein. Alternatively, some versions of door system (10) may simply not provide a substantial seal between the environments that are separated by door system (10).

Exemplary Internal Construction of Door Panels

The internal construction of door panels (12, 14) of the present example is depicted in FIGS. 4-7 with respect to just one particular door panel (12, 14). It should be understood that, in the present example, and unless explicitly stated otherwise herein, the construction of door panel (12) is substantially similar to the construction of door panel (14)—albeit with door panels (12, 14) having different yet complementary leading edges (32). However, it should also be understood that some versions of door system (10) may include door panels (12, 14) having internal and/or external constructions that differ from each other in some fashion.

As shown in FIGS. 4-7, door panels (12, 14) of the present example each comprise composite skin components (102, 110), insulating core components (104, 106, 108), and an outer skin (150). In particular, insulating core components (104, 106, 108) are positioned between opposing composite skin components (102, 110). Composite skin members (102, 110) of the present example are formed of unitary sheets of neoprene foam rubber bonded to a material that is substantially flexible and substantially vapor proof (e.g., polyester reinforced PVC, etc.), though it should be understood that any other suitable material or combination of materials may be used. As shown only in FIG. 4, an additional inner skin member (102*a*) may be included, though it should be understood that inner skin member (102*a*) may be substituted, supplemented, or omitted if desired. Being formed of neoprene foam and/or polyurethane foam, composite skin members (102, 110) of the present example are substantially non-rigid, and are capable of absorbing impact from objects striking or colliding with door panels (12, 14).

Insulating core components (104, 106, 108) of the present example comprise a rear pocket member (104), insulation (106) and an insulation cartridge (108). The pocket member (104) is flexible in the present example and is constructed of flexible PVC; although other materials may be used. Pocket member (104) forms a series of horizontal pockets that are configured to insertingly receive insulation and/or insulation cartridges (106, 108). The back of pocket member (104) is secured to composite skin member (102) by a bonding material; however, the front of pocket member (104) is not bonded directly to front composite skin member (110) in the present example. The front of pocket member (104) may thus slide to some degree relative to front composite skin member (110). In other words, the absence of a bond between front pocket member (108) and front composite skin member (110) may prevent or at least reduce the likelihood of shear stresses being transmitted between front composite skin member (110) and front pocket member (108). However, it should be understood that front pocket member (108) may be bonded to or otherwise secured to front composite skin member (110) in some versions; in addition to or in lieu of rear pocket member (104) being bonded to composite skin member (102).

Figure 4:
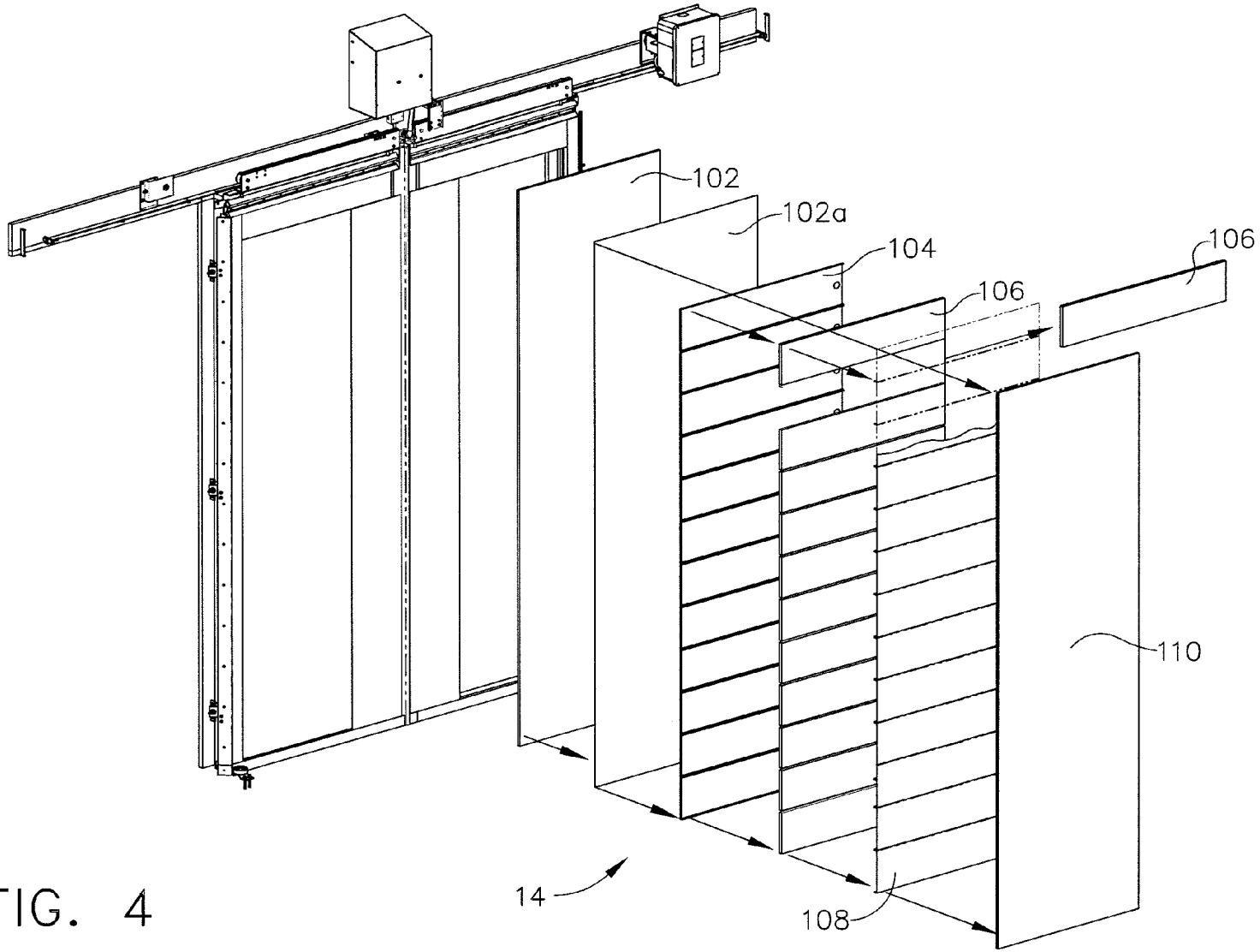
FIG. 4 depicts a perspective view of the two-panel door system of FIG. 1, with one of the door panels being shown in an exploded view.
Figure 5:
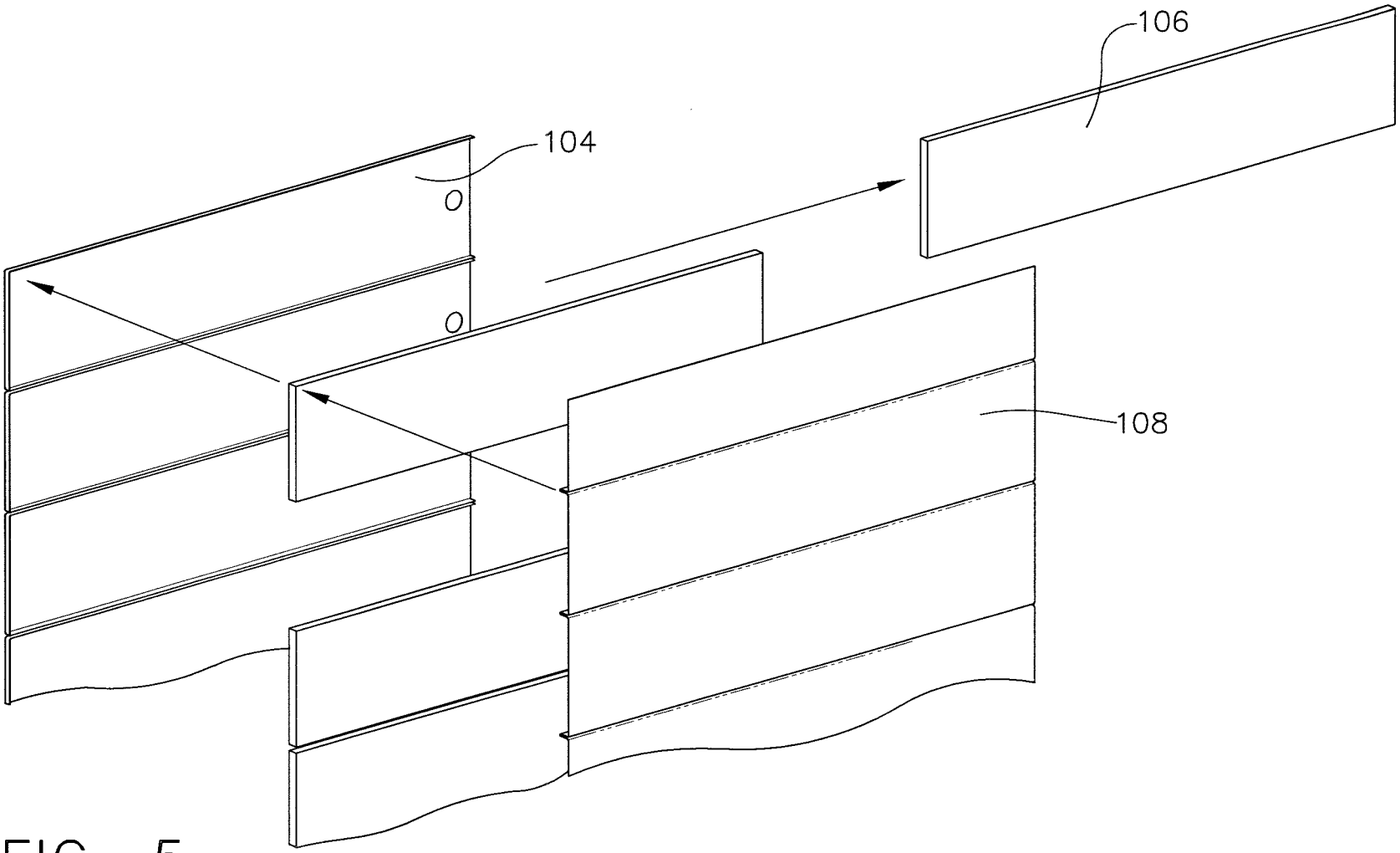
FIG. 5 depicts a partial view of the exploded door panel of FIG. 4.

Insulation and/or insulation cartridges (106, 108) of the present example are substantially rigid. By way of example only, insulation (106) may be formed of volara foam and/or any other suitable material or combination of materials. Alternatively, insulation cartridges (108) may include the insulation (106) and have a protective cover to prevent damage to some of the more sensitive insulations; may be formed of any other suitable material or combination of materials; may be substantially flexible; and/or may have any other suitable properties. While twelve insulation/insulation cartridges (106, 108) are used in each door panel (12, 14) in the present example, it should be understood that any other suitable number of insulation cartridges (106) may be used. With pockets that are formed by pocket member (104) being discrete and separate, the configuration of pocket member (104) provides insulation/insulation cartridges (106, 108) in a segmented arrangement in the present example. With such a segmented arrangement, insulating core components (104, 106, 108) may provide a degree of flexibility for door panels (12, 14) (e.g., facilitating impact absorption, etc.), despite the rigidity of insulation cartridges (106, 108). Of course, some versions of door system (10) may include insulation/insulation cartridges (106, 108) that are flexible and/or may lack a segmented arrangement of insulation cartridges (106) (e.g., insulation cartridges (106) may be substituted with a single unitary insulation sheet, etc.). As shown in FIGS. 4-5, insulation/insulation cartridges (106, 108) may have a modular aspect. In particular, the construction of door panels (12, 14) may permit different types of insulation/insulation cartridges (106, 108) to be inserted in the pockets defined by pocket member (104), as desired. Door systems (10) may thus be customized on a per-installation basis with relative ease, such as by permitting the selection and use of insulation/insulation cartridges (106, 108) based on the desired R value of the core, based on the desired flexibility of the core, and/or based on other considerations.

Figure 6:
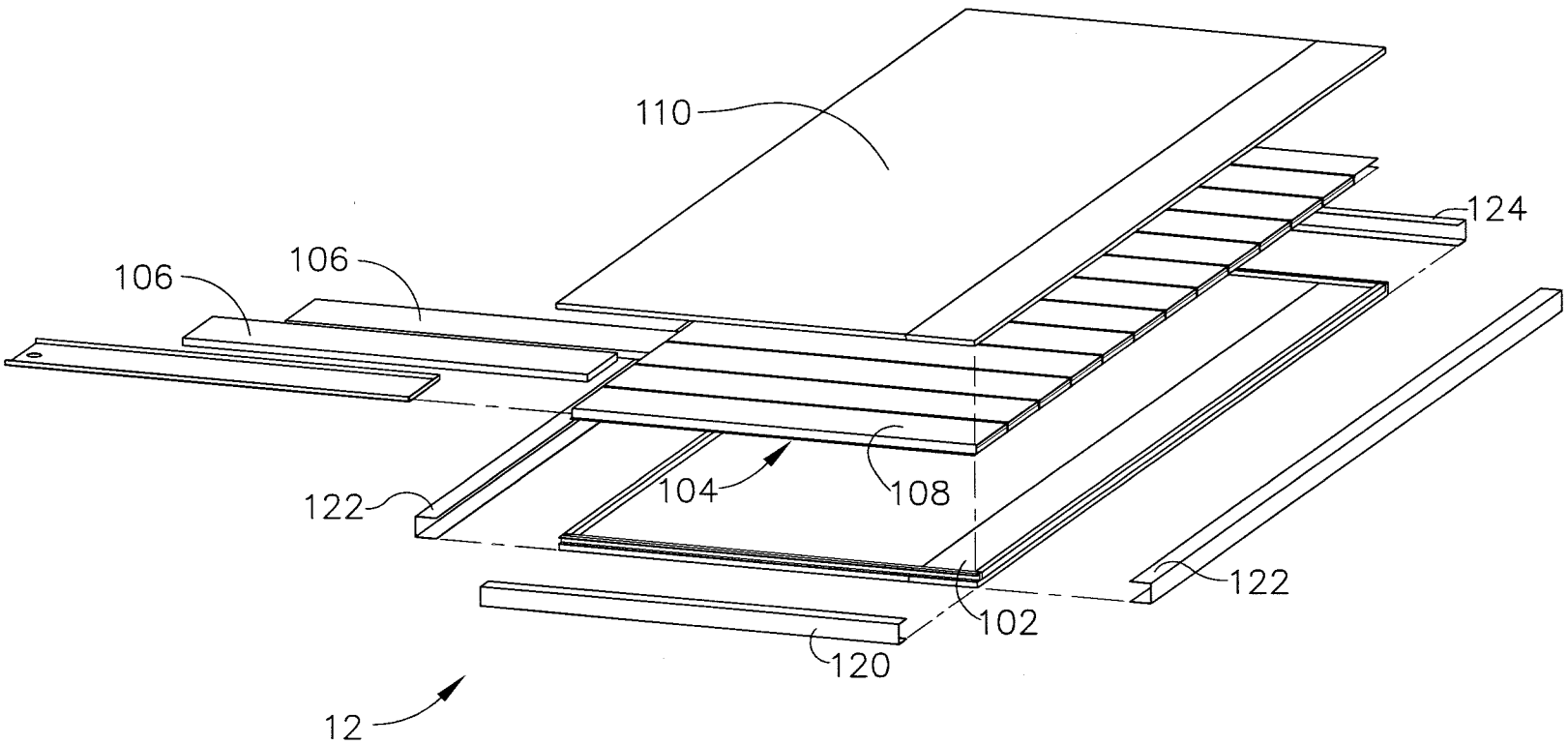
FIG. 6 depicts an exploded perspective view of another one of the door panels of the two-panel door system of FIG. 1.

As shown in FIG. 6, a plurality of edge members (120, 122, 124) may be provided at the outer edges of composite skin components (102, 110). In particular, a lower edge member (120) may be provided at the lower edges of composite skin components (102, 110); an upper edge member (124) may be provided at the upper edges of composite skin components (102, 110); and side edge members (122) may be provided at the sides of composite skin components (102, 110). Edge members (120, 122, 124) of the present example are flexible, and are formed of vinyl. Alternatively, edge members (120, 122, 124) may be formed of any other suitable material or combination of materials; and may have any other suitable properties. In some other versions, edge members (120, 122, 124) are simply omitted.

Figure 7:
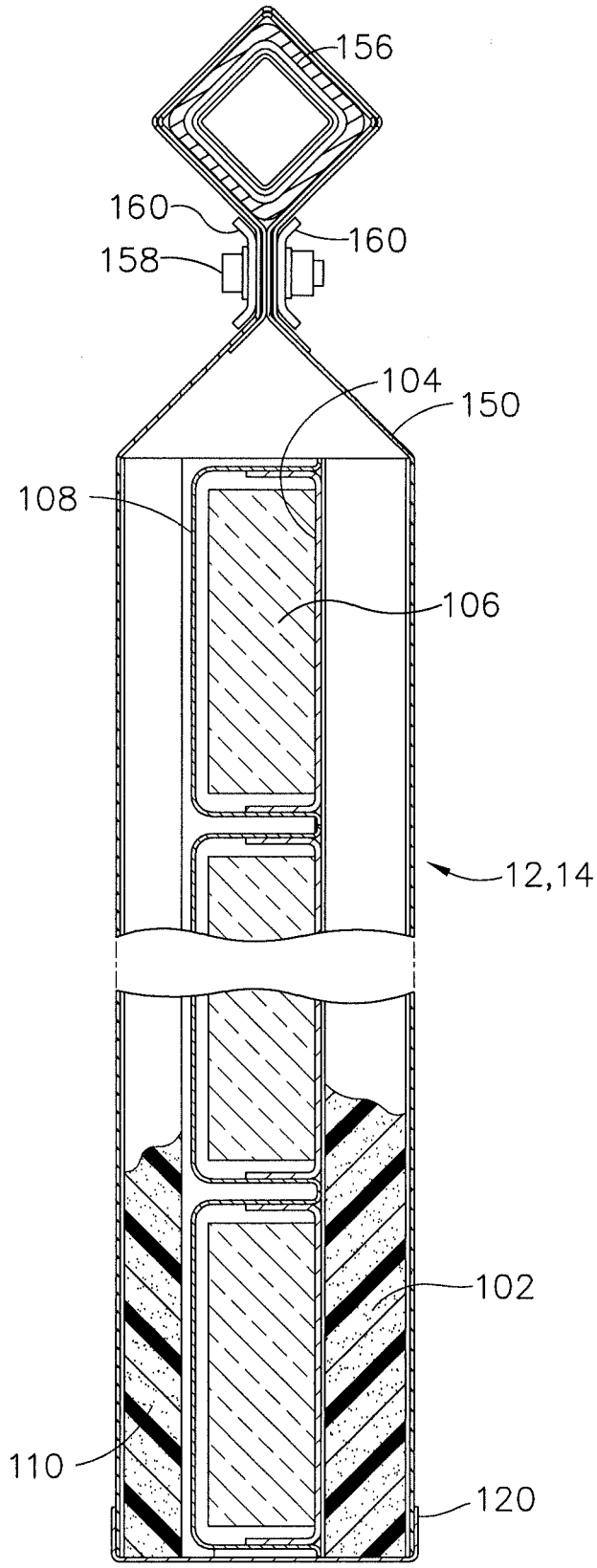
FIG. 7 depicts a side cross-sectional view of one of the door panels of the two-panel door system of FIG. 1, showing engagement of the door panel with a carrier engagement structure.

In the present example, and as best seen in FIG. 7, outer skin (150) encompasses the entire assembly of composite skin components (102, 110) and insulating core components (104, 106, 108). Outer skin (150) of the present example is formed of flexible PVC that is reinforced with polyester fiber, though it should be understood that any other suitable material or combination of materials may be used. By way of example only, any flexible, vapor tight fabric may be used. As shown in FIG. 7, outer skin (150) is bonded directly to inner skin member (102) in the present example. Outer skin (150) may thus provide core protection, add an additional layer of vapor protection, and/or add at some insulation value to the door (among other features), if desired. To the extent that edge members (120, 122, 124) are used, it should be understood that outer skin (150) may be external to and/or bonded to any or all of such edge members (120, 122, 124). Alternatively, edge members (120, 122, 124) may be external to and bonded to outer skin (150). Of course, outer skin (150) need not be bonded to edge members (120, 122, 124), regardless of whether edge members (120, 122, 124) are internal to and/or external to outer skin (150).

In some versions, outer skin (150) for each door panel (12, 14) consists of a single sheet of material that terminates at the lower edges of its corresponding door panel (12, 14). An additional skin, such as a fabric (not shown), may then be provided at the lower edges of door panels (12, 14). Alternatively, as shown in FIG. 7, lower edge member (120) may be positioned external to outer skin (150), and may be secured to the terminating lower portions of outer skin (150). As yet another merely illustrative alternative, outer skin (150) for each door panel (12, 14) may terminate at any other suitable position(s) relative to its corresponding door panel (12, 14). As still another merely illustrative alternative, outer skin (150) may be substantially continuous (e.g., such that its free ends are joined directly together in any suitable fashion). Still other ways in which an outer skin (150) may be provided and configured will be apparent to those of ordinary skill in the art in view of the teachings herein.

As also shown in FIG. 7, outer skin (150) of each door panel (12, 14) in the present example encompasses a corresponding support tube (156). In particular, outer skin (150) is draped over support tube (156). A horizontal binder (160) is positioned on each side of outer skin (150), and a plurality of fasteners (158) secure the binders (160) to outer skin (150). Alternatively support tube (156) may be omitted (e.g., such that the binder (160) itself and/or any other component supports door panel (12, 14), etc.). By way of example only, each horizontal binder (160) may comprise a strip of steel positioned on each side of outer skin (150). As another merely illustrative example, a horizontal binder (160) may comprise a single clamping member that wraps around an end of outer skin (150) to clamp onto both sides of outer skin (150). Fasteners (158) may include bolts, rivets, an adhesive, snap-fittings, and/or any other suitable type of fasteners.

In some versions, outer skin (150) is draped over support tube (156) in a way such that outer skin (150) is a single continuous piece of material extending from front face (30) of door panel (12, 14) to rear face of door panel (12, 14). For instance, in some such versions, outer skin may terminate along the lower edge of door panel (12, 14), configured and oriented like an upside-down "U". In some other versions, a first piece of outer skin (150) extends upwardly from front face (30) of door panel (12, 14) and around support tube (156); while a second, separate, piece of outer skin (150) extends upwardly from rear face of door panel (12, 14) and around support tube (156). In some such versions, and as shown in FIG. 7, the two pieces of outer skin (150) are in an overlapped relationship as they wrap about support tube (156) and as they are held by horizontal binder (160). Various other suitable ways in which outer skin (150) may be configured, oriented, and secured will be apparent to those of ordinary skill in the art in view of the teachings herein.

It should be understood from the foregoing that door panels (12, 14) essentially hang from their corresponding support tube (156) (if present, or the binder (160), etc.) by outer skin (150) in the present example, such that outer skin (150) bears the weight of door panel (12, 14). With outer skin (150) being flexible in the present example, such a hanging configuration may further increase the ability of door panels (12, 14) to absorb impacts or collisions. For instance, the flexibility of outer skin (150) may permit door panels (12, 14) to swing relative to support tube (156) in response to impacts on door panels (12, 14). Alternatively, door panels (12, 14) may be coupled with support tubes (156) in any other suitable fashion. Support tubes (156) (if present, or binders (160), etc.) are unitarily coupled with carriers (60) in the present example, such that translation of carriers (60) along tracks (19) of track system (18) provides corresponding translation of door panels (12, 14) relative to tracks (19) to selectively open and close door system (10). Still other suitable ways in which door panels (12, 14) may be coupled with a track system (18) will be apparent to those of ordinary skill in the art in view of the teachings herein.

Door system (10) may provide any suitable R value. By way of example only, some versions of door system (10) may provide an R value of at least approximately 7 per inch of thickness. As another merely illustrative example, some versions of door system (10) may provide an R value of at least approximately 10 for the entire thickness of door panels (12, 14). As yet another merely illustrative example, door system (10) may provide an R value between approximately 4 (inclusive) and approximately 50 (inclusive). As noted above, the R value of door system (10) may be based at least in part on the selection of insulation cartridges (106). For instance, the R value of door system (10) may depend at least in part on the material used for insulation/insulation cartridges (106, 108), the number of insulation/insulation cartridges (106, 108) used, the thickness of insulation/insulation cartridges (106, 108), the spacing of insulation/insulation cartridges (106, 108), and/or other characteristics associated with insulation/insulation cartridges (106, 108). Door system (10) may thus be customized (e.g., per the needs of a customer or particular installation, etc.) based on the selection of insulation/insulation cartridges (106, 108); and such customization may be facilitated in some versions based on the modularity of insulation/insulation cartridges (106, 108) and the manner in which the construction of door panels (12, 14) permits interchangeability of insulation/insulation cartridges (106, 108). Of course, the R value of door system (10) may also depend on various other factors.

It should be understood from the foregoing that the internal construction of door panels (12, 14) in some versions of door system (10) may provide an appreciable ability for door panels (12, 14) to withstand an impact or collision. For instance, in some versions, and as described above, front composite skin member (110) and rear composite skin member (102) are only attached to each other about their periphery (e.g., by edge members (120, 122, 124) and/or by outer skin (150)). That is, in some versions, there are no direct attachments within the interior of door panels (12, 14) connecting front composite skin member (110) and rear composite skin member (102). In some settings, such a construction may reduce the likelihood of or prevent the transmission of shearing loads at the core of door panels (12, 14) as door panels (12, 14) are bent. Avoiding the transmission of shear stress between front composite skin member (110) and rear composite skin member (102) may make door panels (12, 14) more flexible and less prone to damage when impacted by vehicles, objects, etc. in some settings. Furthermore, positioning insulation/insulation cartridges (106, 108) within the interior of door panels (12, 14) as described herein may help protect insulation/insulation cartridges (106, 108) in some settings. For instance, outer skin (150) and composite skin components (102, 110), as well as the segmented arrangement of insulation/insulation cartridges (106, 108), may substantially protect insulation/insulation cartridges (106, 108) from damage when an object or vehicle, etc. impacts or collides with door panels (12, 14). Furthermore, the "disconnect" between front pocket member (108) and front composite skin member (110) may reduce or prevent shearing stresses, bending stresses, and/or other types of stresses in insulation/insulation cartridges (106) when an object or vehicle, etc. impacts or collides with door panels (12, 14), which may thus minimize or preventing damage to door panels (12, 14) during collisions.

While examples have been described above relating to the internal construction of door panels (12, 14), it should be understood that door panels (12, 14) may alternatively have any other suitable construction. Such alternative constructions may include a variety of other components, materials, arrangements of components, etc. Other suitable ways in which door panels (12, 14) may be constructed will be apparent to those of ordinary skill in the art in view of the teachings herein.

Exemplary Selective Rigidity of Door Panels

Figure 10:
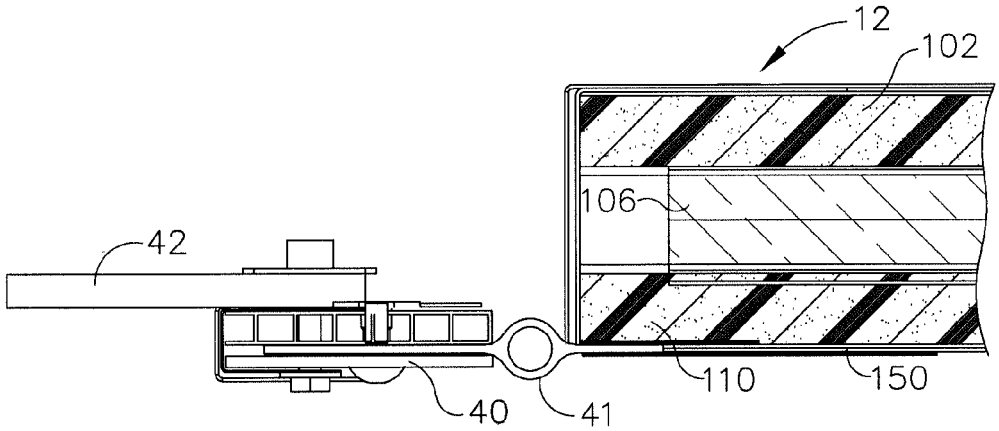
FIG. 10 depicts a partial top plan view of the door panel components of FIG. 8, showing door frame engagement components of the door panel while the door panel is in an open or impacted configuration.

As noted above, and as shown in FIGS. 8 and 10, each door panel (12, 14) in the present example includes a vertical plate (40) that is coupled with the trailing edge of door panel (12, 14) via a continuous hinge (41). Of course, a variety of other types of hinges may be used, including but not limited to a living hinge, several discrete segmented hinges, etc.; or some alternative to a hinge or other structure. As also noted above, a plurality of keepers (42) are secured to such plates (40); and such keepers (42) are configured to engage hooks (52) that are secured to casing (50). It should be understood that the pivotability of plates (40) relative to door panels (12, 14) may provide selective rigidity for door panels (12, 14). In particular, in some versions, when plates (40) are pivoted to a position where they are non-parallel with door panels (12, 14), such as is shown in FIG. 8, plates (40) may provide significant additional rigidity to door panels (12, 14). By contrast, when plates (40) are pivoted to a position where they are substantially parallel with door panels (12, 14), such as is shown in FIG. 10, plates (40) may be more capable of flexing with door panels (12, 14) (e.g., such as upon impact or collision of an object or vehicle with door panel (12, 14), etc.). Such selective rigidity may be due in part to the moment of inertia of plate (40) about a line extending horizontally along a plane defined by door panel (12, 14). In particular, the width of each plate (40) is greater than its thickness. The moment of inertia of plate (40) about a line extending horizontally along a plane defined by door panel (12, 14) is therefore greater when plate (40) is non-parallel to door panel (12, 14) as compared to the moment of inertia of plate (40) about a line extending horizontally along a plane defined by door panel (12, 14) when plate (40) is substantially parallel to door panel (12, 14).

As noted above, the engagement of hooks (52) and keepers (42) provide plates (40) in a non-parallel position relative to door panels (12, 14) when door system (10) is closed. Door panels (12, 14) are thus provided with enhanced stiffness or rigidity when door system (10) is closed, which may in turn enhance the sealing and thermal isolation/insulation capabilities of door system (10). However, when a door panel (12, 14) is struck by an object or vehicle, etc., hooks (52) and keepers (42) may disengage, plate(s) (40) may rotate to a position that is substantially parallel to the door panel(s) (12, 14) that has/have been struck; and such a substantially parallel position of plate(s) (40) may better allow plate(s) (40) to bend or flex more easily with the door panel(s) (12, 14) that has/have been struck.

Plates (40) may even remain in a substantially non-parallel position relative to door panels (12, 14) when door system (10) is open, opening, closing, etc. For instance, plates (40) may tend to stay in or move to a non-parallel position relative to door panels (12, 14) due in part to inertia, one or more camming features in hinges (41) (e.g., cam responsive to gravitational pull on plate (40), etc.), one or more resilient members slightly biasing plates (40) to non-parallel position, and/or based on other factors or features. However, when a door panel (12, 14) is struck while door system (10) is open, opening, closing, etc., the plate (40) of the struck door panel (12, 14) may tend to swing to its lowest strain energy position, which would be substantially parallel to its door panel (12, 14) as shown in FIG. 10. As noted above, door panel (12, 14) may be more flexible when its associated plate (40) has been rotated to a substantially parallel position such as the position shown in FIG. 10.

It should be understood from the foregoing that the pivoting nature of plates (40) may provide selective rigidity to door panels (12, 14)—with additional rigidity being provided when door panels (12, 14) are not being struck by an object or vehicle, etc.; and with flexibility being provided when door panels (12, 14) are struck by an object or vehicle, etc. The striking of a door panel (12, 14) by an object may thus essentially convert the door panel (12, 14) from being substantially rigid to being substantially flexible, thereby allowing the door panel (12, 14) to better absorb the impact of the object. In the present example, door panels (12, 14) are substantially rigid "by default" (e.g., when door panels (12, 14) are not being struck by an object), due to positioning of plates (40) as shown in FIG. 8. Of course, a variety of other components and configurations may be used to provide selective rigidity to door panels (12, 14).

Other Optional Features

Door system (10) may optionally have any of the features disclosed in U.S. Pub. No. 2006/0090401, entitled "Air Heated, Flexible Door Panel," published May 4, 2006, the disclosure of which is incorporated by reference herein. For instance, door system (10) may include a frost control system (e.g., forcing hot air through heat passages (36), etc.) as taught in U.S. Pub. No. 2006/0090401. As another merely illustrative example, cartridges (104, 106) may be configured in accordance with the tiled rectangular insulation pieces taught in U.S. Pub. No. 2006/0090401. As yet another merely illustrative example, door system (10) may include any of the various closure assistance and/or sealing assistance features taught in U.S. Pub. No. 2006/0090401, including but not limited to various kinds of magnet configurations, camming floor brackets, etc. As another merely illustrative example, door system (10) may include an auto-reset feature as taught in U.S. Pub. No. 2006/0090401. It should therefore be understood that any of the features and components of a door system as taught in U.S. Pub. No. 2006/0090401 may be combined with each other and may be combined with the teachings of door system (10). Various suitable permutations of such teachings, as well as various suitable ways in which such combinations and permutations of teachings may be carried out, will be apparent to those of ordinary skill in the art in view of the teachings herein.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometries, materials, dimensions, ratios, steps, and the like discussed above are illustrative and are not required. Accordingly, the scope of the present invention should be considered in terms of claims that may be presented, and is understood not to be limited to the details of structure and operation shown and described in the specification and drawings.

We claim:

1. A door system, comprising:

(a) a door panel, wherein the door panel comprises:

(i) a first layer, wherein the first layer is formed of a first flexible material, (ii) a second layer, wherein the second layer is formed of a second flexible material, and (iii) a third layer, wherein the third layer comprises a plurality of discrete insulation pieces interposed between the first layer and the second layer, wherein the third layer further comprises a plurality of pockets, wherein each discrete insulation piece of the plurality of discrete insulation pieces is inserted in a respective pocket of the plurality of pockets, wherein a first portion of each pocket is interposed between the first layer and a respective one of the discrete insulation pieces of the plurality of discrete insulation pieces, wherein a second portion of each pocket is interposed between the second layer and a respective one of the discrete insulation pieces, wherein the each of said discrete insulation pieces is interposed between the first and second portions of a respective one of said pockets, wherein the plurality of pockets are bonded to the first layer, wherein the plurality of pockets are not bonded to the second layer, such that the plurality of pockets are movable relative to the second layer;

(b) a support member coupled with the door panel, wherein the support member is configured to support the door panel; and (c) a carriage assembly coupled with the support member, wherein the carriage assembly is operable to move the door panel through a range of motion along a path that is substantially parallel to the ground.

2. The door system of claim 1, wherein the first layer comprises a unitary sheet of neoprene foam rubber, wherein the second layer comprises a unitary sheet of neoprene foam rubber.

3. The door system of claim 1, wherein the plurality of pockets are formed of a flexible polyvinylchloride material.

4. The door system of claim 1, wherein the plurality of discrete insulation pieces are substantially rigid.

5. The door system of claim 1, wherein the first layer and the second layer each have a respective pair of side edges and a respective lower edge, wherein the door panel further comprises a first edge member secured to the lower edges of the first and second layers, wherein the door panel further comprises a second edge member secured to the side edge of the first layer, wherein the second edge member is further secured to the side edge of the second layer.

6. The door system of claim 1, further comprising an outer skin, wherein the outer skin encompasses the first, second, and third layers.

7. The door system of claim 6, wherein the outer skin is secured to the support member.

8. The door system of claim 7, wherein the door panel is secured to the support member by the outer skin, such that the outer skin bears the weight of the door panel.

9. The door system of claim 8, wherein the outer skin is wrapped about the support member.

10. The door system of claim 6, wherein the outer skin comprises a flexible polyvinylchloride material.

11. The door system of claim 10, wherein the polyvinylchloride material is reinforced with polyester fiber.

12. The door system of claim 1, wherein the door panel includes a side extending substantially vertically, in a direction substantially perpendicular to the ground, the door system further comprising:

(a) a hinge; and (b) a vertical plate, wherein the vertical plate is secured to the side of the door panel by the hinge, such that the vertical plate is pivotable relative to the door panel, wherein the vertical plate is pivotable between a first position and a second position, wherein the vertical plate is configured provide the door panel with a first rigidity when the plate is in the first position, wherein the vertical plate is configured to provide the door panel with a second rigidity when the plate is in the second position, wherein the first rigidity is greater than the second rigidity, wherein the vertical plate is substantially non-parallel to a plane defined by the door panel when the vertical plate is in the first position, wherein the vertical plate is substantially parallel to the plane defined by the door panel when the vertical plate is in the second position.

13. The door system of claim 12, further comprising a casing, wherein the door panel is movable relative to the casing, wherein the vertical plate is selectively engageable with the casing.

14. The door system of claim 13, wherein the casing comprises a plurality of hooks, wherein the vertical plate comprises a plurality of keepers, wherein the plurality of hooks are configured to selectively engage the plurality of keepers to hold the vertical plate in the first position when the door panel is in a closed position.

15. The door system of claim 1, further comprising a second door panel.

16. A door system, the door system comprising:

(a) a door panel, wherein the door panel comprises:

(i) a vertically extending leading side, (ii) a vertically extending trailing side, (iii) a horizontally extending upper side, and (iv) a horizontally extending lower side;

(b) a casing, wherein the casing is mountable to a doorway, wherein the door panel is movable relative to the casing, wherein the casing comprises a plurality of hook members;

(c) a vertical plate, wherein the vertical plate comprises a plurality of keeper members configured to selectively engage and disengage respective hook members of the plurality of hook members; and (d) a hinge coupling the vertical plate with the trailing side of the door panel, wherein the hinge provides pivotal movement of the vertical plate relative to the door panel about an axis parallel to the vertically extending trailing side of the door panel;

wherein the vertical plate is configured to adjust the rigidity of the door panel based on the pivotal position of the vertical plate relative to the door panel, wherein the vertical plate is configured to pivot to cause the plurality of keeper members and the plurality of hook members to disengage upon the door panel being impacted.

* * * * *